US005238374A

United States Patent [19]

Martens

[11] Patent Number: 5,238,374

[45] Date of Patent: Aug. 24, 1993

[54] APPARATUS FOR CONTROLLING DENSITY PROFILE IN A CONCRETE EXTRUDED SLAB

[75] Inventor: Ernst Martens, Winnipeg, Canada

[73] Assignee: Ultra Span, a Division of Alphair Ventilating Systems, Inc., Canada

[21] Appl. No.: 652,919

[22] Filed: Feb. 11, 1991

[51] Int. Cl.[5] ..... B28B 17/00

[52] U.S. Cl. ..... 425/64; 264/70; 425/262; 425/432

[58] Field of Search ..... 425/62, 63, 64, 65, 425/262, 426, 427, 432, 456; 264/70

[56] References Cited

U.S. PATENT DOCUMENTS

| | | | |
|---|---|---|---|
| 3,159,897 | 12/1964 | Ellis et al. | 425/64 |
| 3,224,064 | 12/1965 | Hummel et al. | 425/63 |
| 3,989,230 | 11/1976 | Martens | 425/64 |
| 4,067,676 | 1/1978 | Hewitt | 425/64 |
| 4,125,348 | 11/1978 | Martens | 425/432 |
| 4,133,619 | 1/1979 | Wise | 425/432 |
| 4,330,242 | 5/1982 | Putti | 425/432 |
| 4,492,552 | 1/1985 | Murakami et al. | 425/432 |
| 4,710,112 | 12/1987 | Martens | 425/64 |
| 4,718,838 | 1/1988 | Ren et al. | 425/432 |

FOREIGN PATENT DOCUMENTS

| | | | |
|---|---|---|---|
| 0125084 | 11/1984 | European Pat. Off. . | |
| 0125825 | 11/1984 | European Pat. Off. . | |
| 0174923 | 3/1986 | European Pat. Off. . | |
| 0192884 | 9/1986 | European Pat. Off. . | |
| 2010571 | 9/1971 | Fed. Rep. of Germany | 425/64 |
| 2020223 | 11/1979 | United Kingdom . | |

*Primary Examiner*—Jay H. Woo
*Assistant Examiner*—Scott Bushey
*Attorney, Agent, or Firm*—Larson and Taylor

[57] ABSTRACT

In the extrusion of hollow core concrete slabs, the density profile across the slab is controlled by the vibration of a hammering plate forming one side of a packing chamber through which the concrete is extruded. Vibrations are imparted to the hammering plate by a vibrator that acts to produce vibratory motions in the plate that are not parallel to the direction of extrusion. With two vibrators producing vibratory components both in the direction of extrusion and outwardly to opposite sides of the packing chamber, the flow of concrete to the side edges of the slab is augmented. In an auger-type extruder, this allows the outer augers to be run at a slower speed than otherwise, thus increasing their service life. The vibratory frequency may also be reduced considerably, thus reducing the noise generated by operation of the apparatus.

5 Claims, 2 Drawing Sheets

APPARATUS FOR CONTROLLING DENSITY PROFILE IN A CONCRETE EXTRUDED SLAB

FIELD OF THE INVENTION

The present invention relates to the manufacture of hollow core concrete slabs.

BACKGROUND OF THE INVENTION

Hollow core concrete slabs are conventionally produced by an extruding machine with a frame mounted on a pair of rails by wheels on the frame. A pallet extends between the rails. A hopper is carried by the frame and feeds a concrete mix downwardly to a set of augers which are driven to pick up the concrete mix and compress it within a packing chamber to form a slab with parallel longitudinal bores formed by the augers. The compression of the concrete drives the machine forwardly on the rails, with the slab being extruded behind the machine. As the compressed concrete is extruded, a hammering plate of the packing chamber is vibrated using rotary vibrators operating at high speed, conventionally 10,800 RPM, on an axis perpendicular to the direction of extrusion. The vibration initially assists with the concrete flow through the packing chamber and then is used to compact the concrete mix.

In order to provide the required compaction of the concrete at the sides of the slab, it has been conventional to operate the augers adjacent the sides of the slab at a rotational speed greater than that of the remaining augers. It is to be understood that the augers adjacent the sides must feed a greater quantity of concrete into the packing chamber than the interior augers. The high vibration rate has been found necessary to provide a satisfactory product, although the noise generated is a significant problem.

The present invention is concerned with certain improvements in such an apparatus and methods for extruding concrete slabs.

SUMMARY OF THE INVENTION

According to one aspect of the present invention there is provided an apparatus for extruding concrete slabs with hollow cores, the apparatus having a plurality of augers for extruding concrete mix in a rearwards direction from a packing chamber, a hammering plate forming one side of the packing chamber and vibrator means for vibrating the hammering plate, wherein the vibrator means comprises at least one vibrator acting on the plate to produce vibratory motions having components transverse to the rearwards direction.

The transverse vibrations induce a lateral concrete flow in the packing chamber, so that the concrete density across the slab may be controlled. Thus, for example, the two conventional rotary vibrators may be arranged with their axis converging in the downstream direction to cause a concrete flow towards the sides of the slabs. The side augers may be driven at the same speed as the remaining augers. This reduced speed will increase the service life of the outermost augers to match that of the inner augers. Other density variations can be achieved where desired through appropriate orientation of the vibrators.

It has also been found that by using multiple, non-aligned vibrators, lower speed vibrators may be used. Thus, according to another aspect of the present invention there is provided an apparatus wherein the rotary vibrators comprise motors with a nominal rotational speed of 3,800 RPM. This significantly reduces the sound emitted by the machine. Compared with the prior art vibrators operating at 10,800 RPM, the present invention allows the use of vibrators operating at considerably less than 10,000 RPM, preferably less than 4,00 RPM. Vibrators operating at a standard motor speed of 3,600 RPM have been found satisfactory.

The invention has proven especially effective when used in conjunction with machines using augers of the type described in U.S. Pat. No. 4,710,112, issued Dec. 1, 1987.

BRIEF DESCRIPTION OF THE DRAWINGS

In the accompanying drawings, which illustrate an exemplary embodiment of the present invention.

DETAILED DESCRIPTION

Figure 1:
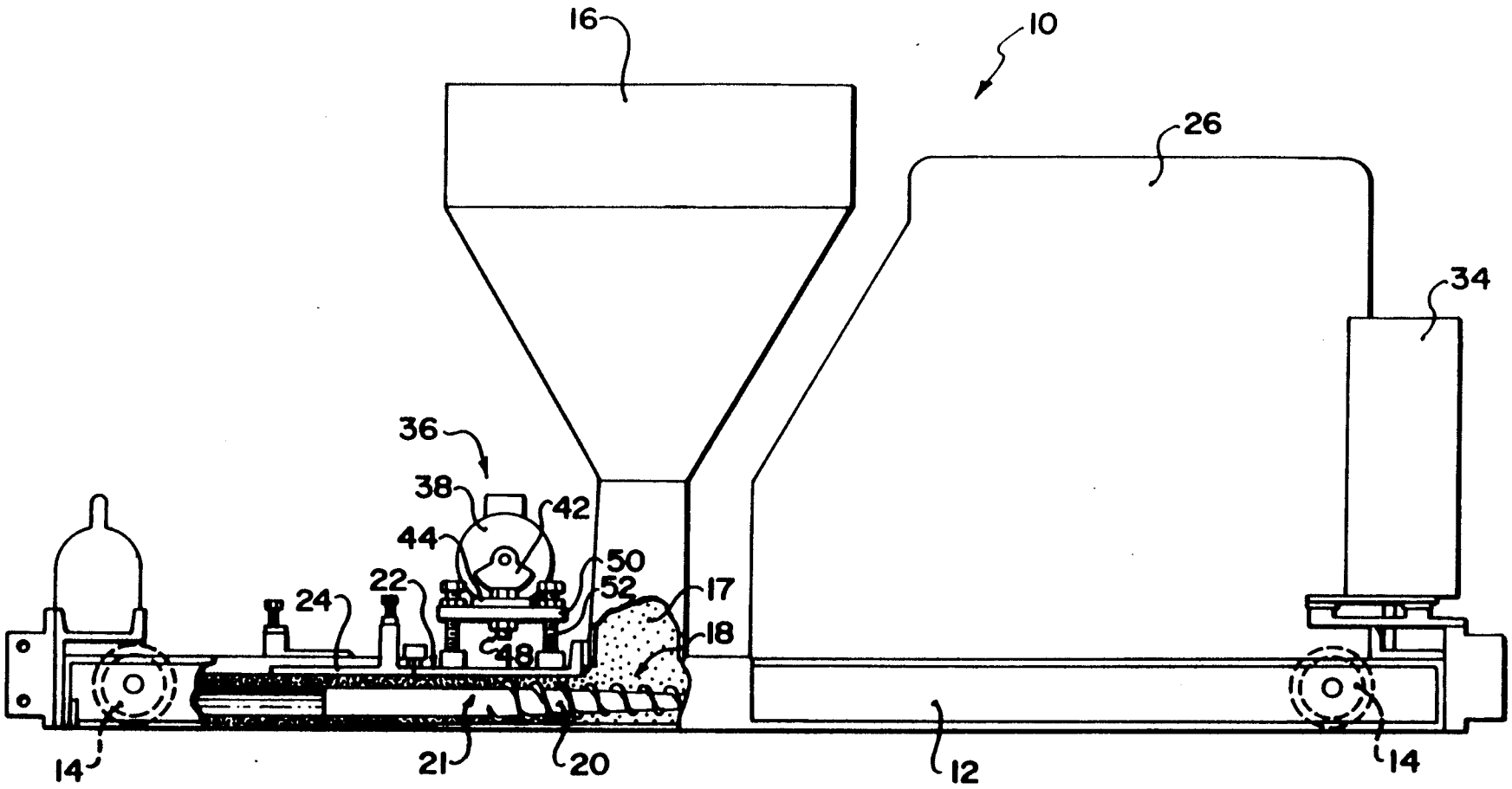
FIG. 1 is a schematic side elevation, partially broken away of a slab extruding apparatus including the present invention.

Referring to the accompanying drawings there is illustrated a concrete slab extruding apparatus 10 that includes a frame 12 with supporting wheels 14. The wheels are mounted on a pair of rails (not illustrated) in the conventional manner.

The frame carries a hopper 16 which supplies concrete mix 17 downwardly into an extruding chamber 18 where it is picked up by augers 20 for delivery into a packing chamber 21. Above the packing chamber adjacent the hopper is a hammering plate 22 for assisting in the compaction of the concrete mix in the packing chamber. Downstream of the hammering plate is a trowelling plate 24.

Figure 2:
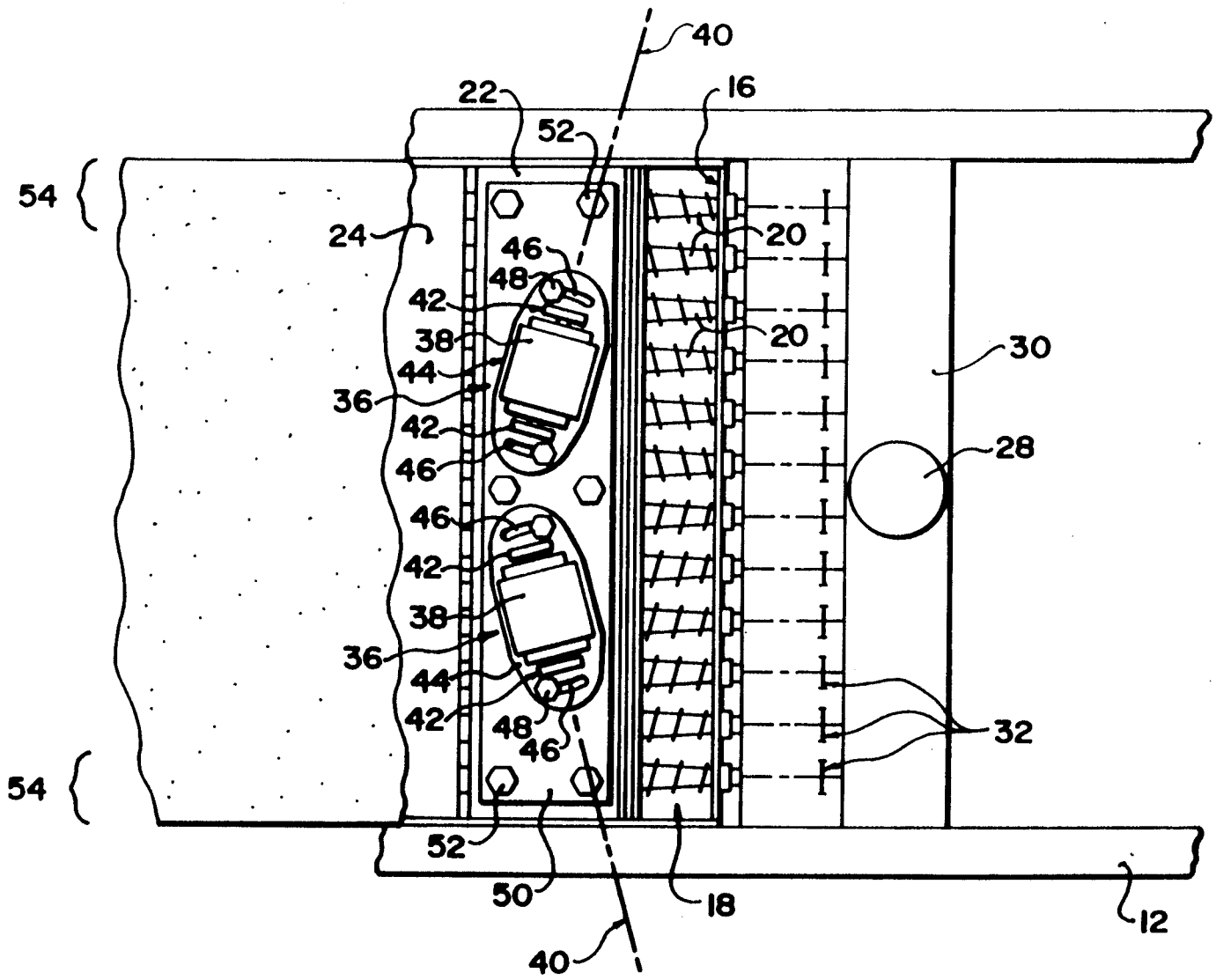
FIG. 2 is a schematic, fragmentary plan view of the apparatus of FIG. 1.

In a direction upstream of the hopper 16, the frame carries a drive housing 26 that encloses a motor 28 (schematically illustrated in FIG. 2). The motor drives a gearbox assembly 30 that in turn drives sprockets 32 on each of the augers 20 through a chain drive (not illustrated). Upstream of the drive housing 26, the frame carries an electrical panel 34 with all of the controls for the apparatus.

The hammering plate 22 carries two vibrators 36, arranged side by side above the hammering plate. Each vibrator consists of a motor 38 with an axis of rotation 40 and a series of eccentric weights 42 mounted on the motor drive shaft. The weights are mounted on both ends of the motor shaft and each preferably consists of a series of metal plates that can be added and substracted to vary the weight driving the vibrations.

Each of the motors 38 is mounted on a base plate 44. The base plate has arcuate slots 46 adjacent each end that receive respective clamping bolts 48 that secure the base plate to a support plate 50. The support plate 50 is mounted on the hammering plate by a set of adjustable columns 52 that allow adjustment of the height of the support plate above the hammering plate.

In the embodiments illustrated in the drawings, the two vibrator motors 38 are arranged with their axes 40 converging towards the centre of the slab in the direction of extrusion. This has been found to produce a lateral flow of concrete in the packing chamber towards the zones 54 at the sides of the slab. This increases the packing of the concrete in these zones so that the conventional operation of the outermost augers at higher speed may be eliminated.

The vibrator motors 38 in the illustrated embodiment operate at a standard motor speed of 3,600 RPM. This has been found, with the arrangement illustrated, to provide satisfactory compaction of the concrete in the packing chamber. In the prior art, it was found necessary to operate the vibrator motors at much higher speed, usually a nominal speed of 10,800 RPM, in order to provide an adequate compaction. The reduced motor speed significantly reduces the sound emitted during operation of the apparatus.

While one embodiment of the present invention has been described in the foregoing, it is to be understood that other embodiments are envisaged and are intended to be included within the scope of the invention. For example, while the illustrated embodiment deals with the augmented packing of the concrete along the side edges of the slab, other effects may be achieved where desired by alternative orientations of the vibrators to control the concrete density profile from side to side of the slab.

As noted above the invention has proven especially effective when used in conjunction with augers of the type described in U.S. Pat. No. 4,710,112 issued Dec. 1, 1987. However, the invention is not limited to this use.

I claim:

1. An apparatus for extruding concrete slabs with hollow cores, the apparatus having a plurality of augers for extruding concrete mix in a rearwards direction through a packing chamber, a hammering plate forming one side of the packing chamber and vibrator means for vibrating the hammering plate, the vibrator means comprising two rotary vibrators spaced apart transversely of the packing chamber and acting on the hammering plate to produce vibratory motions of the hammering plate, wherein the axes of rotation of the vibrators are non-parallel and converge towards the center of the slab.

2. An apparatus according to claim 1 including means for rotating all of the augers at a common rotational speed.

3. An apparatus according to claim 1 wherein the rotary vibrators comprise motors with a rotational speed less than 10,000 RPM.

4. An apparatus according to claim 1 wherein the rotary vibrators comprise motors with a rotational speed less than 4,000 RPM.

5. An apparatus according to claim 1 wherein the rotary vibrators comprise motors with a nominal rotational speed of 3,800 RPM.

* * * * *